United States Patent [19]

Högberg

[11] 4,421,596

[45] Dec. 20, 1983

[54] METHOD RELATING TO DISSOLVING MOLTEN SMELT

[75] Inventor: Ebbe T. Högberg, Karlstad, Sweden

[73] Assignee: Billerud Uddeholm Aktiebolag, Säffle, Sweden

[21] Appl. No.: 359,491

[22] Filed: Mar. 18, 1982

[30] Foreign Application Priority Data

Mar. 23, 1981 [SE] Sweden ..... 8101843

[51] Int. Cl.[3] ..... D21C 11/04

[52] U.S. Cl. ..... 162/30.11; 423/DIG. 3

[58] Field of Search ..... 422/185; 162/29, 30.1, 162/30.11; 65/19; 423/207, DIG. 3

[56] References Cited

U.S. PATENT DOCUMENTS 3,122,421 2/1964 Gettle ..... 423/DIG. 3

4,280,982 7/1981 Shindone ..... 422/185

FOREIGN PATENT DOCUMENTS 43195 9/1916 Sweden .

84444 9/1935 Sweden .

334214 7/1968 Sweden .

*Primary Examiner*—Peter F. Kratz

*Attorney, Agent, or Firm*—Murray and Whisenhunt

[57] ABSTRACT

At the dissolving of molten smelt from the so called spouts at a chemical recovery apparatus in a sulphate pulp plant, the molten chemicals which are discharged from the recovery boiler are desintegrated into smaller droplets, which fall down into the bath where the chemicals shall be dissolved in an aqueous solution to produce green liquor. For the desintegration there is used one or more jets of an air-water mist.

10 Claims, 4 Drawing Figures

1
2
3
4
5
6
7
9
10
11

METHOD RELATING TO DISSOLVING MOLTEN SMELT

FIELD OF INVENTION

This invention relates to the chemical recovery in a sulphate pulp plant. More particularly the invention concerns a method relating to dissolving the molten so called smelt, which is discharged from a smelt spout in a chemical recovery apparatus in a sulphate pulp plant. The invention also relates to a device for desintegrating a stream of molten material, particularly a device for desintegrating said chemical recovery smelt.

BACKGROUND OF THE INVENTION

At the combustion of black liquor in the recovery boiler in a sulphate pulp plant there is obtained a molten residual product together with the sodium sulphate which is supplied to replace the consumption of chemicals. This consists substantially of sodium carbonate and sodium sulphide and is continuously discharged through a number of spouts, the so called smelt spouts, from the bottom portion of the recovery boiler. This stream of molten material is dissolved in an aqueous solution in a soda dissolving tank. The aqueous solution may consist of weak white liquor from the causticizing plant. The produced solution is pumped to the causticizing plant for further treatment.

The smelt has a temperature of about 900° C. as it is discharged from the recovery boiler. It is therefore not possible to let this molten stream pour down directly into the aqueous solution in the dissolving tank, as this would cause explosions. It is therefore conventional to disintegrate the molten stream into small droplets before the smelt is allowed to come into contact with the aqueous solution. Further it is conventional to use water steam for the disintegration of the smelt from the recovery boiler. However, steam is a valuable product due to its energy content. The consumption of steam for smelt desintegration therefore is a considerable cost factor in the chemical recovery.

It is from other technical fields also known to desintegrate streams of molten material, for example molten metal, by means of a jet of water. This technique, however, is not useful for desintegrating the stream of molten smelt from the smelt spout because of explosion hazard involved when a water jet is brought into contact with the smelt.

DISCLOSURE OF THE INVENTION

It is an object of the invention to bring about a method and a simple apparatus for the desintegration of the molten smelt from the spouts in a chemical recovery apparatus. More particularly it is an object to perform this in a manner which is most advantageous from an energy saving view. Further, it is an object that the method and the apparatus are simple and that they readily may be adapted to existing chemical recovery apparatuses.

Another object of the invention is to provide a device and to perform the method in such a manner that the jet of the air-water mist is prevented from diverging but such that it will impact the stream of molten material with sufficient momentum for desintegrating it into droplets.

These and other objects can be achieved therein that the molten chemicals which are discharged from the recovery boiler, and which form a stream of molten smelt, under free fall are desintegrated into smaller droplets by means of one or more jets consisting of a mist of tiny water particles in air, whereafter the droplets fall down into the bath where the chemicals are to be dissolved in an aqueous solution in order to produce green liquor. Preferably the jet of air-water mist is suitably directed obliquely downwards against the stream of molten smelt.

The method of the invention is based on the theory that every little water droplet in the air-water mist, which penetrates the red hot stream of molten smelt, shall be surrounded by an "air cushion", capable of damping the violent expansion of the water droplets when they hit the smelt and hence prevent the explosive process which would take place if water would come into direct contact with the smelt.

Experiments have shown that the air-water mist should be blown against the stream of molten smelt with an intensity corresponding to a supply of 30–200 kg water, preferably 50–150 kg water per hour, corresponding to about 20–60% water in the air-water mist, which accordingly also should supply air towards the smelt to an amount of 45–300 kg, suitably 75–225 kg air per hour. It should also be understood that this water partly can evaporate as it leaves the nozzle as well as during the passage between the nozzle and the stream of molten smelt. The figures mentioned above refer to all water leaving the nozzle disregarding the fact that this water to some extent can be evaporated prior to hitting the stream of molten smelt.

A device suitable for the present method includes a nozzle assembly comprising a water discharge nozzle, a surrounding gas discharge nozzle directed at an oblique angle at the center axis of the water discharge nozzle such that a contracted jet of a gas-water mist may be formed when a gas jet discharged from said gas discharged nozzle impinges against a water jet discharged from said water discharge nozzle. Members are suitably provided for rotating at least one or said gas jet and water jet, preferably both of said jets, about there joint center axis. The gas discharge nozzle is most advantageously circular and coaxial with the water discharge nozzle. Although the nozzle assembly has been developed and adapted for desintegrating a smelt stream from the chemical recovery apparatus in a pulp mill, in which case the gas consists of air, it is also conceivable to use a device designed according to the invention also for desintegrating a stream of other types of melt, e.g. for desintegrating molten metal for producing metal granules, metal powder, shots, and the like.

Further objects with and characteristic features of the invention will be apparent from the following description of a preferred embodiment.

SHORT DESCRIPTION OF DRAWINGS

In the following description of a preferred embodiment, reference will b be made to the accompanying drawings, in which FIG. 1 schematically shows the desintegration of a stream of molten smelt from the smelt spout from a chemical recovery boiler.

DESCRIPTION OF PREFERRED EMBODIMENT

Figure 1:
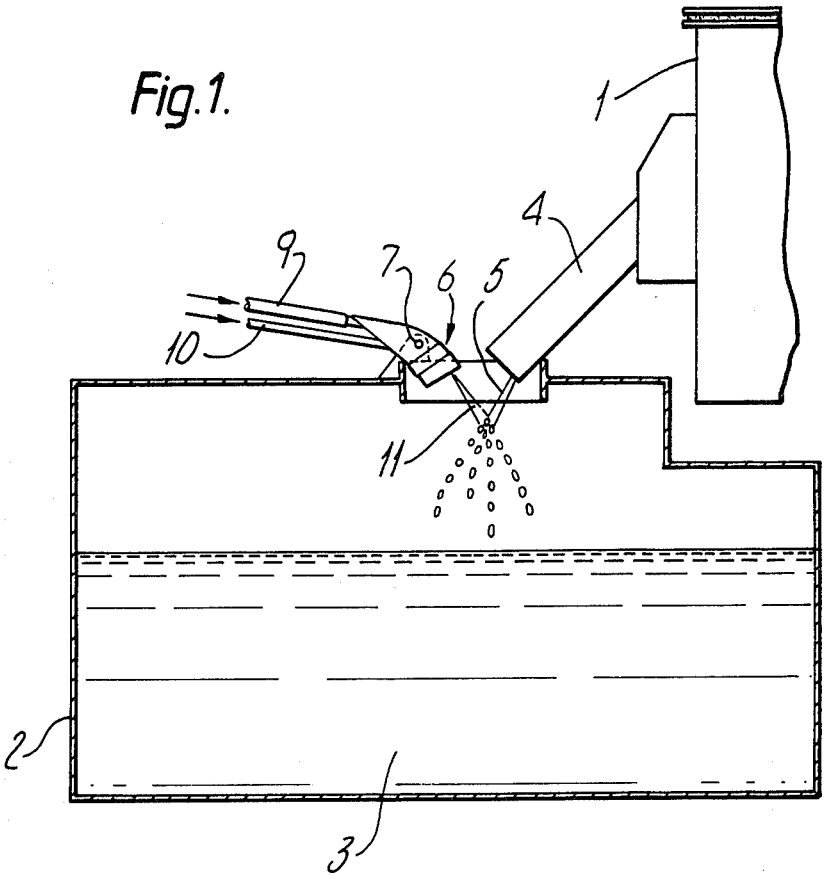
Figure 2:
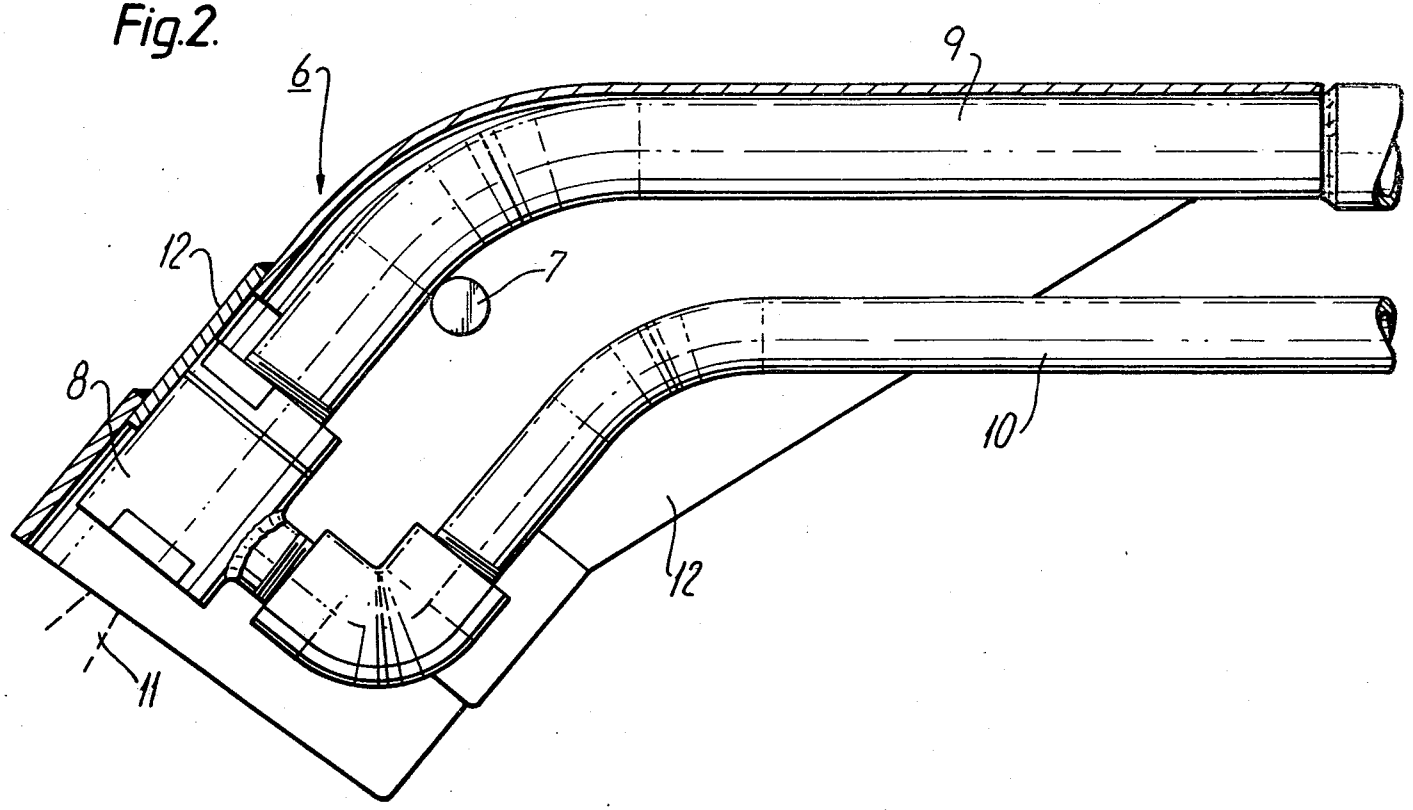
FIG. 2 is a side view of a nozzle assembly which is used in the method of the invention, as well as the orientation of the nozzle compared to the stream of molten smelt.

Reference is first made to FIG. 1, in which a chemical recovery boiler generally is shown as 1 and a soda dissolving tank as 2. The soda dissolving tank 2 contains a bath 3 consisting of an aqueous solution, usually weak white liquor or weak liquor from the causticizing plant. The molten chemicals are discharged from the recovery boiler 1 via a smelt spout 4, whereafter the smelt under free fall in the form of a stream of molten smelt 5 falls down towards the bath 3. At the side of the stream of molten smelt 5 there is provided one or more nozzle assemblies 6 according to the invention. The nozzle assembly 6 may be pivoted about a hinge 7 in order to direct the jet of an air-water mist intended to be blown against the stream of molten smelt 5 under desired angle against said stream of molten smelt. Suitably the air-water mist is directed under an angle of about 45° obliquely downwards against the stream of molten smelt 5.

FIG. 5 shows the nozzle assembly 6 more in detail. As is shown in the drawing, air and water are supplied through separate supply conduits 9 and 10 respectively to a joint nozzle housing 8. The nozzle assembly 6 also comprises a casing 12 surrounding the conduits 9, 10 and the nozzle housing 8, which also includes the hinge 7 for the adjustment of the assembly 6 at a desired angle against the stream of molten smelt 5.

Figure 3:
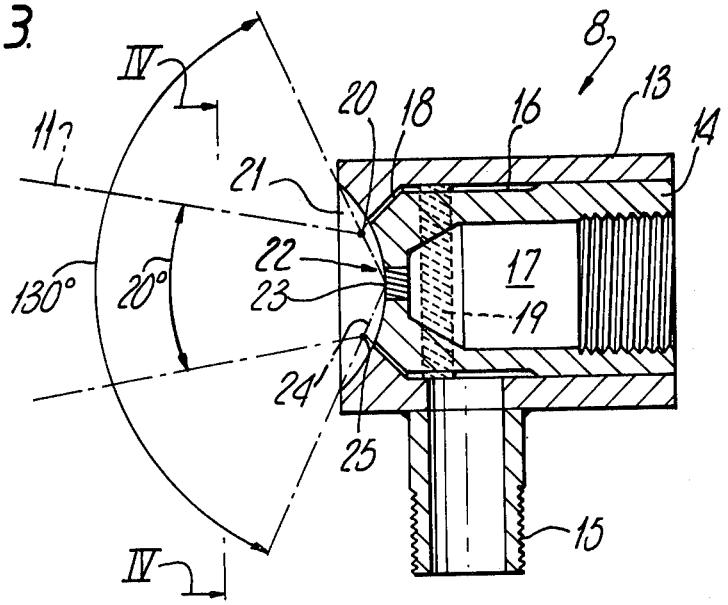
FIG. 3 is a longitudinal section whrough a nozzle housing included in the nozzle assembly of FIG. 2.
Figure 4:
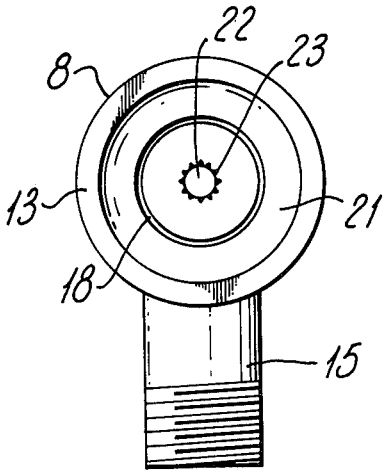
FIG. 4 is a section IV—IV in FIG. 3.

With reference now to FIG. 3 and FIG. 4 the nozzle housing 8 consists of an outer tubular member 13 and an inner tubular member 14. An air conduit connection 15 terminates into an annular space 16 between said outer and inner tubular members 13 and 14. The annular space 16 is closed at its rear end and converge in its front end into an annular nozzle 18, which more particularly has the shape of the frustum of a cone. This imaginary cone has a top angle of 45°, such that a conical air jet 20 from the annular nozzle 18 is directed at an angle of 45° against the centre axis. In the annular space 16 there are members 19 provided to cause compressed air flowing through space 16 from the air conduit 10 to the nozzle 18 to rotate. These members 19 may consist of screw shaped grooves, slots, fans or the like.

A water inlet chamber is shown as 17. In the front wall of the nozzle housing 8 a central water discharge nozzle 22 is provided between the water inlet chamber 17 and a cup-shaped recess 21 in the front wall of the nozzle housing 8. In the central nozzle 22 members 23 of the same or similar type as the members 19 in the annular space 16 are provided to cause the water jet 24 which is discharged at a high rate through nozzle 22 to rotate about the centre axis in the same direction of rotation as the air jet 20 discharged from the surrounding nozzle 18. The water jet 24 diverges heavily as it is released from the central nozzle 22 and may form a solid angle of up to about 130°. Due to impinge from the air jet 20 the resulting air-water mist jet 11, however, is strongly contracted to the shape of a regular cone having a top angle of about 20°. What exactly takes place in the interaction zone 25 between the two primary jets 20 and 24 has not been examined in detail. It can be assumed, however, that the region 25 of interaction between the two primary jets 20 and 24 can be described as a complex pattern of turbulence and eddy currents. Whatever the reason, the desired achievements are obtained, namely the formation of an air-water mist which in the form of a contracted jet 11 may impact the stream 5 of molten smelt with a sufficient momentum to desintegrate the molten smelt into droplets with suitable size.

I claim:

1. A method comprising dissolving molten smelt from the smelt spout in a chemical recovery apparatus in a sulphate pulp plant, characterized therein that the molten chemicals, which are discharged from the chemical recovery boiler, are caused to form a free falling stream, that a jet of air-water mist is formed by impinging an air jet against a water jet, and that the air-water mist jet is directed against the smelt stream such that the molten material is disintegrated into smaller droplets with reduced risk of violent reactions caused by water-smelt contact whereafter said droplets fall down into a bath (3), and the smelt is; dissolved in an aqueous solution to produce green liquor.

2. Method according to claim 1, characterized therein that the air and the water are directed througn separate nozzles and are mixed to form said air-water mist outside the nozzles.

3. Method according to claim 2, characterized in that a water jet (24) is directed through a central nozzle (22) and an air jet (24) is directed through a circular nozzle (18) surrounding the water jet nozzle, said air jet being directed obliquely towards the centre axis of the nozzles to impinge against the water jet.

4. Method according to claim 3, characterized in that at least one of said air and water jets are caused to rotate about their joint centre axis.

5. Method according to claim 4, characterized in that the air jet and the water jet are caused to rotate about their joint axis in the same direction of rotation.

6. Method according to any of claims 1, 2, 3, 4, or 5, characterized in that the jet (11) of said air-water mist forms an angle of between 10° and 30° with the free falling smelt.

7. Method according to claim 1 or 2, characterized therein that the jet of said air-water mist is directed obliquely downwards against the stream of molten smelt.

8. Method according to claim 1, characterized therein that there is blown against the stream of molten smelt 30–200 kg water, preferably 50–150 kg water per hour in the form of said air-water mist.

9. Method according to claim 1, characterized therein that said air-water mist contains 20–60% water in the form of very small water particles, while the remainder substantially consists of air.

10. Method according to claim 1, characterized therein that there is blown towards the stream of molten smelt, in the form of said air-water mist, air in an amount of 45–300 kg air, suitably 75–225 kg air per hour.

* * * * *